US008720393B2

(12) United States Patent
Tsay et al.

(10) Patent No.: US 8,720,393 B2
(45) Date of Patent: May 13, 2014

(54) ENGINE STRUCTURE HAVING CONJUGATE CAM ASSEMBLY

(75) Inventors: Der-min Tsay, Kaohsiung (TW); Hsin-pao Chen, Hualien County (TW); Ting-hao Cheng, Kaohsiung (TW)

(73) Assignee: National Sun Yat-Sen University, Kaohsiung (TW)

( * ) Notice: Subject to any disclaimer, the term of this patent is extended or adjusted under 35 U.S.C. 154(b) by 620 days.

(21) Appl. No.: 12/778,107

(22) Filed: May 11, 2010

(65) Prior Publication Data

US 2011/0277732 A1 Nov. 17, 2011

(51) Int. Cl.
*F01B 9/06* (2006.01)
*F02B 75/04* (2006.01)

(52) U.S. Cl.
CPC ..... *F01B 9/06* (2013.01); *F02B 75/048* (2013.01); *F02B 75/04* (2013.01)
USPC ..... 123/48 B; 123/44 E; 123/54.3; 123/55.3; 123/43 C; 123/192.1; 74/604; 74/595

(58) Field of Classification Search
CPC ..... F02B 75/04; F02B 75/045; F02B 75/048; F02B 75/32; F01B 9/04; F01B 9/06
USPC ..... 74/604, 595, 603, 838; 123/192.2, 48 B, 123/78 E, 197.4, 41.35, 146 E, 46 R, 54.1, 123/43 C, 44 E, 54.3, 55.3, 56.9, 192.1; 300/8, 2; 188/378
See application file for complete search history.

(56) References Cited

U.S. PATENT DOCUMENTS

| | | | | |
|---|---|---|---|---|
| 5,431,130 | A | 7/1995 | Brackett | |
| 5,758,615 | A * | 6/1998 | Kreuter | 123/192.2 |
| 6,029,541 | A * | 2/2000 | Schrick et al. | 74/604 |
| 6,125,802 | A * | 10/2000 | Pen | 123/48 B |
| 6,422,196 | B1 * | 7/2002 | Pien | 123/198 F |
| 6,976,467 | B2 * | 12/2005 | Fantuzzi | 123/197.1 |
| 7,559,611 | B2 * | 7/2009 | Boucherie | 300/8 |
| 2005/0173967 | A1 | 8/2005 | Boucherie | |

FOREIGN PATENT DOCUMENTS

| | | | |
|---|---|---|---|
| CN | 2407137 | Y | 11/2000 |
| CN | 1085782 | C | 5/2002 |
| CN | 1213219 | C | 8/2005 |
| CN | 100432374 | C | 11/2008 |

* cited by examiner

*Primary Examiner* — Lindsay Low
*Assistant Examiner* — Kevin Lathers
(74) *Attorney, Agent, or Firm* — Cheng-Ju Chiang

(57) ABSTRACT

An engine structure having a conjugate cam assembly is provided and includes a piston which can be used to push or pulled by the conjugate cam assembly mounted on a camshaft through a connection rod, a roller rocker and two rollers. The conjugate cam assembly has two cams with cam profiles and relative arrangement angle which can be varied according to actual operational desire, so as to vary the ratio of intake/exhaust strokes and the ratio of compression/power strokes. Thus, the combustion efficiency and the exhaustion efficiency can be enhanced. When the camshaft finishes four strokes of an operational cycle, the camshaft only rotates one circle (i.e. 360 degree), so that the rotation speed of the camshaft can be lowered.

10 Claims, 6 Drawing Sheets

ENGINE STRUCTURE HAVING CONJUGATE CAM ASSEMBLY

FIELD OF THE INVENTION

The present invention relates to an engine structure having a conjugate cam assembly, and more particularly to an engine structure having a camshaft which can finish four strokes in one operational cycle through a conjugate cam assembly that can be further used to adjust the ratio of intake/exhaust strokes.

BACKGROUND OF THE INVENTION

An engine is used to mix a fuel with the air into a combustible mixture gas, and then guide the mixture gas into a cylinder, followed by sparking the mixture gas through a spark plug to cause the combustion of the mixture gas, so as to actuate a piston to reciprocally move in the cylinder. Then, the piston actuates a crankshaft through a connection rod, so that the crankshaft can be used to drive an external mechanism. Generally, the engine is applied to various industrial applications, such as vehicles (including automobiles or motorcycles) or generators, wherein the common engines can be classified into two-stroke type and four-stroke type. For a four-stroke type engine, one operational cycle thereof includes four strokes, as follows:

(1) Intake stroke: Referring now to FIG. 1A, in this stroke, an intake valve 101 of the four-stroke type engine is firstly opened, while an exhaust valve 102 thereof is closed. A piston 103 in a cylinder 100 is gradually shifted from an upper dead point U to a lower dead point L, so that an upper inner volume of the cylinder 100 above the piston 103 is increased. Thus, a predetermined vacuum condition is generated in the cylinder 100 for guiding the combustible mixture gas into the cylinder 100. After the piston 103 is shifted to the lower dead point L, the piston 103 has actuated a crankshaft 106 in a crankcase 105 to rotate a half circle (i.e. 180 degree) through a connection rod 104, so as to close the intake valve 101 and end the intake stroke.

(2) Compression stroke: Referring now to FIG. 1B, after finishing the intake stroke, the intake valve 101 and the exhaust 102 are simultaneously closed. The crankshaft 106 continues to rotate, so as to push the piston 103 to shift from the lower dead point L to the upper dead point U. Thus, the upper inner volume of the cylinder 100 above the piston 103 is decreased, so that the mixture gas in the cylinder 100 will be gradually compressed, while the temperature and the pressure of the mixture gas will be raised. When the crankshaft 106 further rotates a half circle to totally finish one circle (i.e. 360 degree or one revolution) and the piston 103 is shifted to the upper dead point U, the compression stroke is ended.

(3) Power stroke: Referring now to FIG. 1C, when the compression stroke is ended, a spark plug 107 is energized to spark the mixture gas for combustion. Because the combusted mixture gas rapidly explodes to cause the expansion thereof, the pressure and the temperature of the combusted mixture gas will be suddenly increased at very short time, so as to push the piston 103 to rapidly shift downward and cause the rotation of the crankshaft 106 through the connection rod 104 for actuating an external mechanism. During the power stroke, the piston 103 is shifted from the upper dead point U to the lower dead point L, and the crankshaft 106 further rotates a half circle to totally finish one and half circle (i.e. 540 degree). When the piston 103 is gradually shifted to the lower dead point L, the upper inner volume of the cylinder 100 above the piston 103 is increased, so that the pressure and the temperature of the combusted mixture gas will be gradually lowered, (4) Exhaust stroke: Referring now to FIG. 1D, after the combusted mixture gas finishes its combustion to generate exhaust gas, the exhaust gas must be immediately exhausted out of the cylinder 100 for executing the next operational cycle. Thus, after the power stroke is finished, the exhaust valve 102 will be opened, while the piston 103 is gradually shifted upward to exhaust the exhaust gas through the exhaust valve 102. When the piston 103 is shifted to the upper dead point U, the exhaust valve 102 will be closed. At this time, the crankshaft 106 further rotates a half circle to totally finish two circles (i.e. 720 degree), that is also called an operational cycle.

As described above, the four-stroke type engine implements the foregoing four strokes to finish an operational cycle. In one operational cycle, the piston 103 is reciprocally shifted between the upper dead point U and the lower dead point L two times, while the crankshaft 106 is correspondingly rotated two circles. However, there are some technical problems existing in the traditional four-stroke type engine, as follows: In the exhaust stroke, some portion of the exhaust gas is generally remained in the cylinder 100 after finishing the previous operation cycle, so that the remained the exhaust gas affects the efficiency of the intake stroke and the power stroke of the next operation cycle. If the displacement of the piston 103 in the intake stroke, the compression stroke, the power stroke and the exhaust stroke is equal to each other, the ratio of the intake and exhaust volume can not be adjusted, so that the problem of the remained exhaust gas can not be solved. In addition, the crankshaft 106 must rotate one circle to finish the intake stroke and the compression stroke, but the crankshaft 106 can not output any effective power to drive the external mechanism at this time. In other words, the crankshaft 106 only can output effective power during the power stroke and the exhaust stroke. As a result, there is a problem of discontinuous acceleration between the first circle and the second circle of the crankshaft 106. Thus, the rotation speed of the crankshaft 106 is too fast, and components of the external mechanism may bear suddenly increased force, so as to substantially increase the problem of component abrasion and component life reduction. It causes that the traditional four-stroke type engine is not suitably applied to a high-speed rotation condition. To solve the foregoing problems, an engine must arrange two or more sets of four-stroke type engines side by side, in order to mutually compensate the power output vacancy with each other for increasing total power output. However, this arrangement increases the entire volume of the engine, so that it is disadvantageous to reduce the occupied space of the engine.

Therefore, it is necessary to provide an improved four-stroke type engine structure to solve the foregoing problems, as described above.

SUMMARY OF THE INVENTION

A primary object of the present invention is to provide an engine structure having conjugate cam assembly, which has a piston used to push or pulled by a conjugate cam assembly mounted on a camshaft through a connection rod, a roller rocker and two rollers, wherein the conjugate cam assembly has two cams with cam profiles and relative arrangement angle which can be varied according to actual operational desire, so as to vary the ratio of intake/exhaust strokes and the ratio of compression/power strokes. Thus, the combustion efficiency and the exhaustion efficiency can be enhanced, while the power output can be enhanced.

A secondary object of the present invention is to provide an engine structure having conjugate cam assembly, which has a piston used to push or pulled by a conjugate cam assembly mounted on a camshaft through a connection rod, a roller rocker and two rollers, wherein the camshaft only rotates one circle (i.e. 360 degree) when the piston finishes four strokes of an operational cycle. Thus, the variation range of rotation speed of the camshaft can be narrowed, the operational loading of the camshaft can be reduced, the component abrasion of external mechanism can be decreased, and the entire volume of the engine can be minimized.

To achieve the above objects, the engine structure having a conjugate cam assembly of a preferred embodiment of the present invention comprises: a piston received in a cylinder for reciprocally linearly shifting in relation to an axial direction of the cylinder; a connection rod having a first end and a second end, wherein the first end is pivotally connected to the piston, so that the connection rod is simultaneously moved with the piston; a roller rocker having a power source end, a first roller connection point, a second roller connection point and a fulcrum point, wherein the second end of the connection rod is pivotally connected to the power source end for driving the first and second roller connection points to rotate in relation to the fulcrum point; a push roller pivotally connected to the first roller connection point of the roller rocker; a pull roller pivotally connected to the second roller connection point of the roller rocker; and a conjugate cam assembly mounted on a camshaft and having a push cam and a pull cam connected to the push cam; wherein the push cam has a non-circular cam profile different from that of the pull cam; and wherein the cam profile of the push cam is in contact with the push roller, while the cam profile of the pull cam is in contact with the pull roller.

In one embodiment of the present invention, one circle of rotation of the conjugate cam assembly and the camshaft is corresponding to all of a power stroke, an exhaust stroke, an intake stroke and a compression stroke of the piston.

In one embodiment of the present invention, the ratio of the intake stroke and the exhaust stroke is equal to the ratio of a portion of the cam profile of the push cam (or the pull cam) corresponding to the intake stroke and the exhaust stroke.

In one embodiment of the present invention, the ratio of the compression stroke and the power stroke is equal to the ratio of a portion of the cam profile of the push cam (or the pull cam) corresponding to the compression stroke and the power stroke.

In one embodiment of the present invention, the power stroke, the exhaust stroke, the intake stroke and the compression stroke of the piston are corresponding to four displacements defined between a first upper point, a first lower point, a second upper point, a second lower point and the first upper point of the piston in the cylinder, respectively, wherein the first upper point is higher than or equal to the second upper point, and the first lower point is lower than or equal to the second lower point.

In one embodiment of the present invention, the ratio of the intake stroke and the exhaust stroke is equal to the ratio of the displacement between the second upper point and the second lower point of the piston and the displacement between the first lower point and the second upper point of the piston.

In one embodiment of the present invention, the ratio of the compression stroke and the power stroke is equal to the ratio of the displacement between the second lower point and the first upper point of the piston and the displacement between the first upper point and the first lower point of the piston.

In one embodiment of the present invention, the fulcrum point of the roller rocker is pivotally connected to a fixation base on an inner wall of a crankcase through a pivotal member.

In one embodiment of the present invention, the fulcrum point of the roller rocker is pivotally connected to a fixation rod.

In one embodiment of the present invention, a first included angle is defined between a connection line of the power source end and the fulcrum point and a connection line of the first roller connection point and the fulcrum point, and the first included angle is smaller than 90 degree.

In one embodiment of the present invention, a second included angle is defined between a connection line of the power source end and the fulcrum point and a connection line of the second roller connection point and the fulcrum point, and the second included angle is greater than 90 degree.

In one embodiment of the present invention, the size of the push roller is greater than that of the pull roller, while the size of the push cam is greater than that of the pull cam.

In one embodiment of the present invention, a third included angle is defined between a length direction of the push cam and a length direction of the pull cam, and the third included angle is smaller than 90 degree.

In one embodiment of the present invention, the cam profile of the pull cam is substantially disposed within the range of the cam profile of the push cam.

In one embodiment of the present invention, a portion of the cam profile of the pull cam is projected out of the range of the cam profile of the push cam.

DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 3:
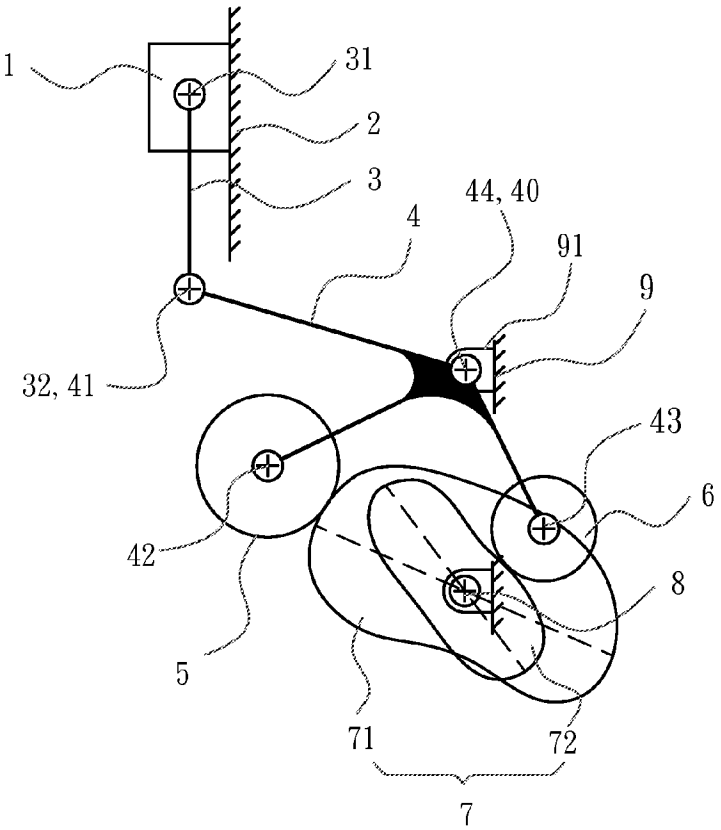
FIG. 3 is a simplified schematic view of the engine structure having conjugate cam assembly according to the first embodiment of the present invention.
Figure 2:
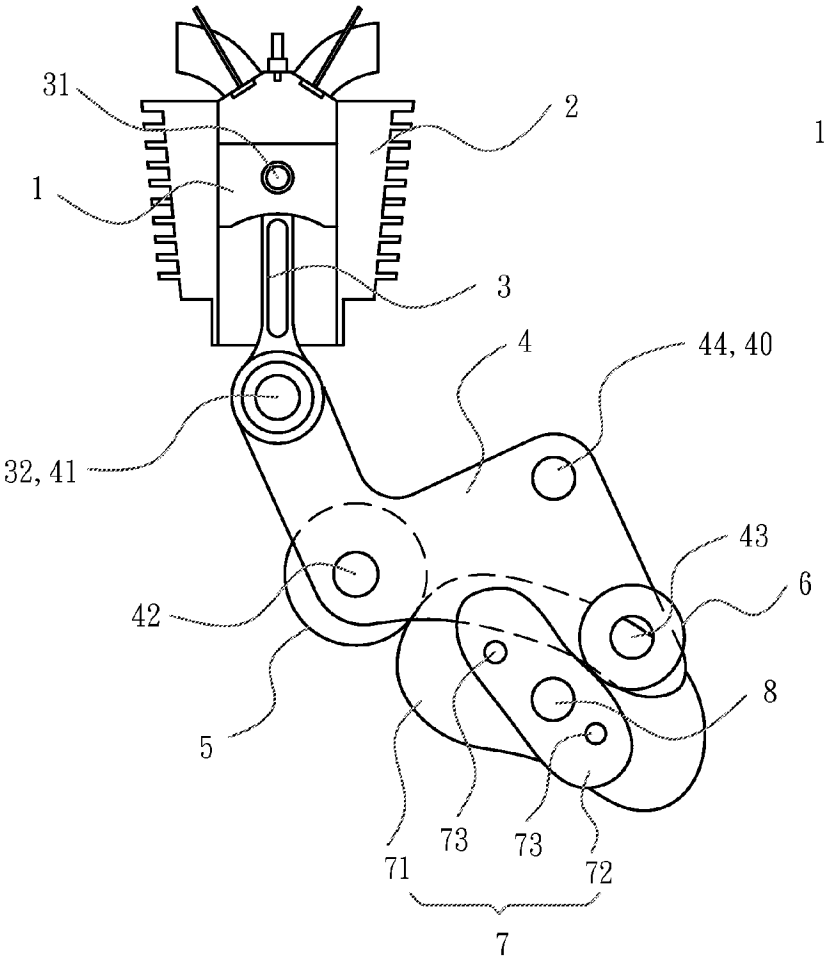
FIG. 2 is an assembled view of an engine structure having conjugate cam assembly according to a first embodiment of the present invention.

Referring now to FIGS. 2 and 3, an engine structure having conjugate cam assembly according to a first embodiment of the present invention is illustrated. As shown, the engine structure having conjugate cam assembly is a four-stroke type engine structure which is mainly applied to various industrial applications, such as vehicles (including automobiles or motorcycles) or generators, but not limited thereto. The engine structure of the present invention comprises a piston 1, a cylinder 2, a connection rod 3, a roller rocker 4, a push roller 5, a pull roller 6, a conjugate cam assembly 7 and a camshaft 8 (also called power shaft or crankshaft), all of which is basically made of metal, alloy or ceramic material, such as aluminum, aluminum alloy, stainless steel or alumina ceramic, but not limited thereto. It should be noted that directional terms (such as upper, lower, left, right, inner, outer, longitudinal, transverse and etc.) of the present invention described hereinafter are based on directions in the accompanying drawings, and these directional terms are only used to describe the installation relationship of relative components, but not limited thereto.

Referring to FIGS. 2 and 3, in the first embodiment of the present invention, the piston 1, the cylinder 2 and the connection rod 3 are similar to that of a traditional engine structure, wherein the piston 1 is a metal cylindrical plug, the cylinder 2 is a hollow metal housing, and the connection rod 3 is an elongated metal rod. The piston 1 is received in a chamber of the cylinder 2 for reciprocally linearly shifting in relation to an axial direction (i.e. a longitudinal direction) of the cylinder 2. The connection rod 3 has a first end 31 and a second end 32, wherein the first end 31 is extended into the cylinder 2 and pivotally connected to the piston 1 through a pin or bolt, so that the connection rod 3 can be reciprocally and longitudinally moved with the piston 1. Moreover, the second end 32 of the connection rod 3 can be pivotally rotated about a small angle range in relation to the first end 31 thereof.

Referring still to FIGS. 2 and 3, in the first embodiment of the present invention, the roller rocker 4 is a zigzag type metal plate having a lightning-like shape or an N-like shape, but not limited thereto. For example, the shape of the roller rocker 4 also can be diamond-shape, parallelogram-shape or tri-fork shape. The roller rocker 4 has a power source end 41, a first roller connection point 42, a second roller connection point 43 and a fulcrum point 44, which are formed on four corner positions of the roller rocker 4, respectively. As shown in a simplified schematic view of FIG. 3, a first included angle is defined between a virtual connection line of the power source end 41 and the fulcrum point 44 and a connection line of the first roller connection point 42 and the fulcrum point 44, and the first included angle is smaller than 90 degree. Meanwhile, a second included angle is defined between a connection line of the power source end 41 and the fulcrum point 44 and a connection line of the second roller connection point 43 and the fulcrum point 44, and the second included angle is greater than 90 degree. Moreover, the fulcrum point 44 of the roller rocker 4 is pivotally connected to a fixation base 91 on an inner wall of a crankcase 9 through a pivotal member 40 (such as a pin or bolt). In assembly, the second end 32 of the connection rod 3 is pivotally connected to the power source end 41 through a pin or bolt, so that the connection rod 3 can transmit a force for driving the first and second roller connection points 42, 43 to simultaneously rotate in relation to the fulcrum point 44 along a clockwise or counterclockwise direction. In addition, the push roller 5 and the pull roller 6 are two short cylindrical or short drum-like components, wherein the push roller 5 is pivotally connected to the first roller connection point 42 of the roller rocker 4 through a pin or bolt, while the pull roller 6 is pivotally connected to the second roller connection point 43 of the roller rocker 4 through a pin or bolt. Besides, the size of the push roller 5 is preferably greater than that of the pull roller 6.

Referring to FIGS. 2 and 3 again, in the first embodiment of the present invention, the conjugate cam assembly 7 is mounted on the camshaft 8 and can be used to actuate the camshaft 8 to simultaneously rotate. The conjugate cam assembly 7 has a push cam 71 and a pull cam 72, wherein the push cam 71 is fixed and connected to the pull cam 72 through at least two fixation members 73 which can be selected from screws without limitation. Alternatively, the push cam 71 and the pull cam 72 can be directly connected to each other by welding, so as to omit the fixation members 73. Furthermore, the push cam 71 has a non-circular cam profile (i.e. an outer periphery) different from that of the pull cam 72, while the size of the push cam 71 is greater than that of the pull cam 72 for matching with the corresponding size of the push roller 5 and the pull roller 6. In addition, as shown in FIG. 3, two dashed lines are illustrated to define a maximum length direction of the push cam 71 and a maximum length direction of the pull cam 72, respectively, wherein a third included angle is preferably defined between the length direction of the push cam 71 and the length direction of the pull cam 72, and the third included angle is smaller than 90 degree. Meanwhile, the cam profile of the pull cam 72 is substantially disposed within the range of the cam profile of the push cam 71. For example, the cam profile of the pull cam 72 is partially in contact with the cam profile of the push cam 71, but not apparently crosses outward the cam profile of the push cam 71. In the present invention, the roller rocker 4 is punched to become non-planar shape, or the cylindrical size of the push roller 5 is designed to be greater than that of the pull roller 6. In this case, a profile of the push roller 5 can be partially in contact with the cam profile of the push cam 71, while a profile of the pull roller 6 can be partially in contact with the cam profile of the pull cam 72. Moreover, the distance from the push roller 5 to the power source end 41 is preferably smaller that the distance from the pull roller 6 to the power source end 41. Therefore, the cam profile of the push cam 71 can be in contact with the profile of the push roller 5, and both of the push cam 71 and the push roller 5 can push each other during a power stroke, an exhaust stroke and a compression stroke. Meanwhile, the cam profile of the pull cam 72 can be in contact with the profile of the pull roller 6, and the pull cam 72 can be pulled by the pull roller 6 during an intake stroke.

Figure 4:
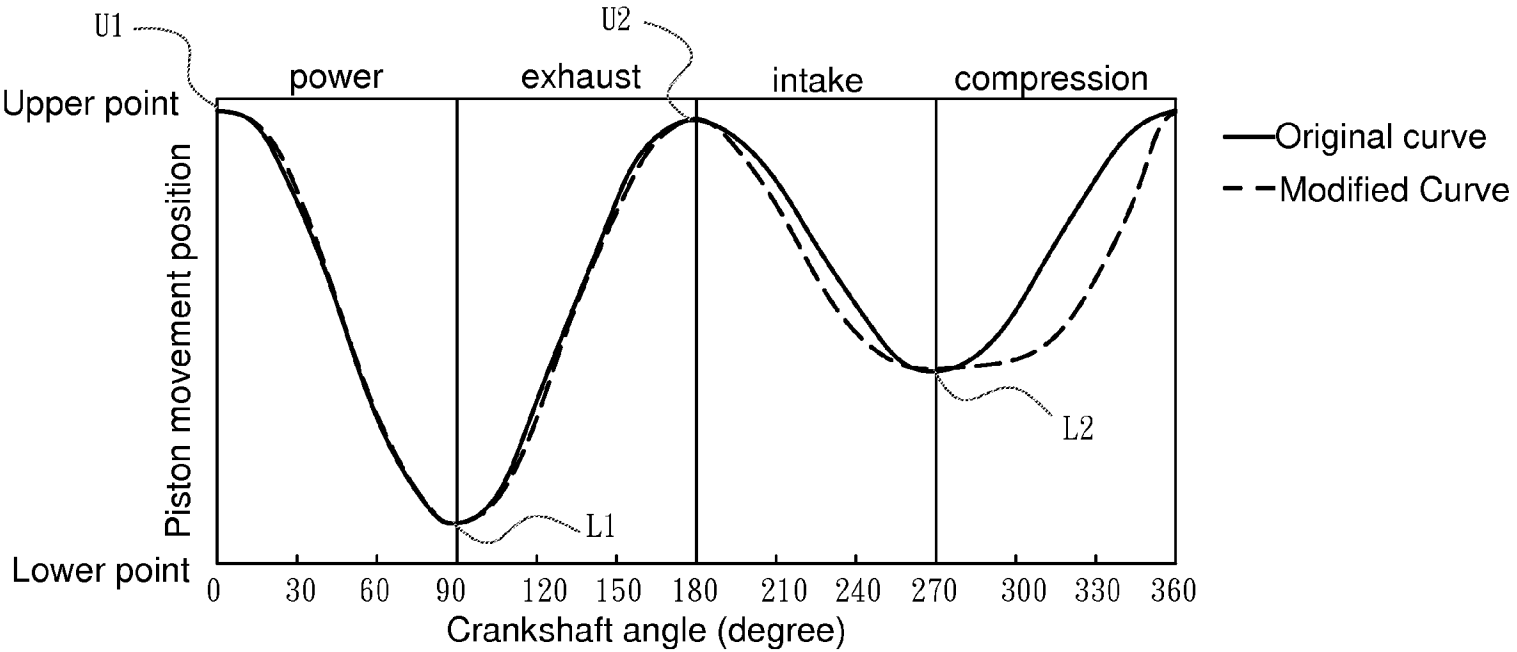
FIG. 4 is a diagram of the camshaft angle and the piston movement position in a power stroke, an exhaust stroke, an intake stroke and a compression stroke of the engine structure having conjugate cam assembly according to the first embodiment of the present invention.
Figure 4:
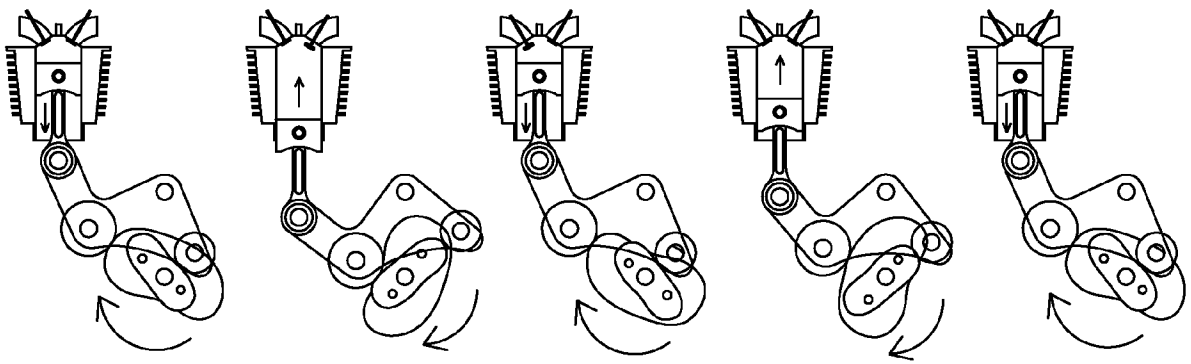

Referring to FIGS. 3 and 4, in the first embodiment of the present invention, when the conjugate cam assembly 4 and the camshaft 8 rotate one circle (i.e. 360 degree), all of the power stroke, the exhaust stroke, the intake stroke and the compression stroke of the piston 1 can be correspondingly finished. As shown in FIG. 4, the solid curve and the dashed curve mean an original curve and a modified curve of a piston movement position. The power stroke, the exhaust stroke, the intake stroke and the compression stroke of the piston 1 are corresponding to four displacements defined between a first upper point $U_1$, a first lower point $L_1$, a second upper point $U_2$, a second lower point $L_2$ and the first upper point $U_1$ of the piston 1 in the cylinder 2, respectively, wherein the first upper point $U_1$ is selectively higher than or equal to the second upper point $U_2$, and the first lower point $L_1$ is selectively lower than or equal to the second lower point $L_2$. In the embodiment, the first upper point $U_1$ is higher than the second upper point $U_2$, and the first lower point $L_1$ is lower than the second lower point $L_2$. Moreover, the ratio of the intake stroke and the exhaust stroke is equal to the ratio of a portion of the cam profile of the push cam 71 (or the pull cam 72) corresponding to the intake stroke and the exhaust stroke, i.e. the ratio of the displacement between the second upper point $U_2$ and the second lower point $L_2$ of the piston 1 and the displacement between the first lower $L_1$ point and the second upper point $U_2$ of the piston 1. On the other hand, the ratio of the compression stroke and the power stroke is equal to the ratio of a portion of the cam profile of the push cam 71 (or the pull cam 72) corresponding to the compression stroke and the power stroke, i.e. the ratio of the displacement between the second lower point $L_2$ and the first upper point $U_1$ of the piston 1 and the displacement between the first upper point $U_1$ and the first lower point $L_1$ of the piston 1. According the cam profiles and corresponding cam circumferences of the push cam 71 and the pull cam 72 corresponding to the four strokes, the displacement degree during the piston 1 is shifted upward or downward can be suitable designed and controlled. The cam profiles and the arrangement angle of the push cam 71 and the pull cam 72 can be varied according to actual operational needs of the engine, in order to adjust the ratio of the displacements of the four strokes. Thus, according to the present invention, the cam profiles and the arrangement angle of the push cam 71 and the pull cam 72 are not limited to fixed values.

Figures 1A, 1B, 1C, 1D:
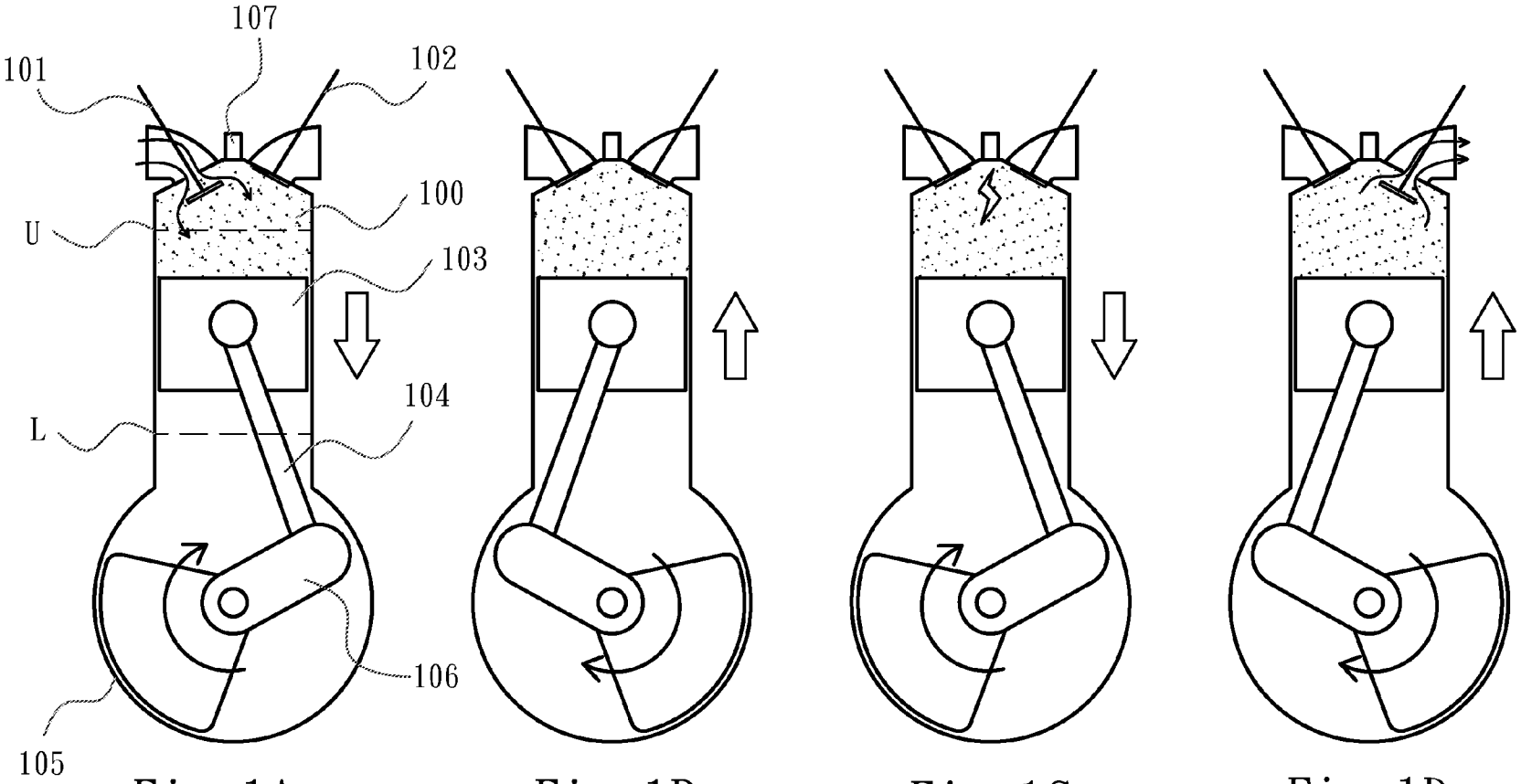
Fig 1A Prior Art
Fig 1B Prior Art
Fig 1C Prior Art
Fig 1D Prior Art
FIGS. 1A, 1B, 1C and 1D are schematic views of an intake stroke, a compression stroke, a power stroke and an exhaust stroke of a traditional four-stroke type engine structure.

To describe more detailed, referring to FIG. 4, when the engine structure having conjugate cam assembly according to the first embodiment of the present invention operates, the combustible mixture gas in the cylinder 2 is sparked by a spark plug (unlabeled) to cause the combustion of the mixture gas during the power stroke of the piston 1. Thus, the combusted mixture gas in the cylinder 2 rapidly explodes to cause the expansion of the mixture gas, so that the piston 1 is shifted from a first upper point $U_1$ to a first lower point $L_1$ in the cylinder 2 to generate a push power for pushing downward the roller rocker 4 through the connection rod 3. Then, the roller rocker 4 can push the push cam 71 of the conjugate cam assembly 7 through the push roller 5, wherein the push roller 5 converts the push power into a rotary torque of the conjugate cam assembly 7, so that the conjugate cam assembly 7 can actuate the camshaft 8 to simultaneously rotate along a clockwise direction. As a result, the camshaft 8 can be used to drive an external mechanism (not-shown), such as a V-belt transmission of the engine or a torque converter. The principle of this power stroke can be referenced by FIG. 1C. During the power transmission of the power stroke, the conjugate cam assembly 7 has a rotary inertia under a certain rotation speed, so as to prevent the piston 1 from stopping at a dead point (i.e. the first upper point $U_1$ or the first lower point $L_1$). According to the operational needs of the engine, the conjugate cam assembly 7 also can be designed to actuate the camshaft 8 to simultaneously rotate along a counterclockwise direction.

Furthermore, referring to FIG. 4 again, during the exhaust stroke of the piston 1, the push cam 71 of the conjugate cam assembly 7 can push the push roller 5 due to the rotary inertia, so as to actuate the roller rocker 4 and the connection rod 3. Thus, the connection rod 3 can actuate the piston 1 to shift upward from the first lower point $L_1$ to a second upper point $U_2$ in the cylinder 2, in order to exhaust the exhaust gas in the cylinder 2. The second upper point $U_2$ is preferably designed to be lower than or equal to the first upper point $U_1$, so that the displacement of the exhaust stroke can be apparently longer than that of the following intake stroke, and then the exhaustion efficiency can be advantageously enhanced. The principle of this exhaust stroke can be referenced by FIG. 1D.

Then, referring still to FIG. 4, during the intake stroke of the piston 1, the pull cam 72 of the conjugate cam assembly 7 can push the pull roller 6 due to the rotary inertia, so as to actuate the roller rocker 4 and the connection rod 3. Thus, the connection rod 3 can actuate the piston 1 to shift downward from the second upper point $U_2$ to a second lower point $L_2$ in the cylinder 2, in order to increase the volume in the cylinder 2 for sucking the combustible mixture gas into the cylinder 2. The second lower point $L_2$ is preferably designed to be higher than or equal to the first lower point $L_1$ according to the actual needs of the engine, so as to relatively shorten the displacement of the intake stroke under a condition that enough mixture gas is inputted. The principle of this intake stroke can be referenced by FIG. 1A.

Finally, referring to FIG. 4 again, during the compression stroke of the piston 1, the push cam 71 of the conjugate cam assembly 7 can push the push roller 5 due to the rotary inertia, so as to actuate the roller rocker 4 and the connection rod 3. Thus, the connection rod 3 can actuate the piston 1 to shift upward from the second lower point $L_2$ to the first upper point $U_1$ in the cylinder 2, in order to compress the mixture gas in the cylinder 2 for preparing to carry out the combustion and explosion of the next power stroke. The principle of this compression stroke can be referenced by FIG. 1B. The piston 1 and the conjugate cam assembly 7 can reciprocally carry out the four strokes for the next operational cycle, so as to maintain the continuous operation of the engine.

When the piston 1 finishes the four strokes (i.e. the power stroke, the exhaust stroke, the intake stroke and the compression stroke), the conjugate cam assembly 7 and the camshaft 8 only rotate one circle (i.e. 360 degree), so that the circle number per operational cycle of the camshaft 8 can be advantageously lowered. Thus, the range of the rotation speed of the camshaft 8 can be narrowed, while the operational loading of the camshaft 8 can be reduced. In addition, the discontinuous acceleration of the rotation of the camshaft 8 can be prevented, so that components of the external mechanism may not bear suddenly increased force, so as to substantially lower the problem of component abrasion for increasing the life of the components. Thus, the engine is suitable applied to a high-speed rotation condition. Meanwhile, the four-stroke type engine of the present invention can be independently operated without arranging two or more sets of the four-stroke type engines side by side, so that the entire volume of the engine can be decreased. In addition, referring to an original curve and an amended curve of FIG. 4, when the cam profiles and the initial arrangement angle of the push cam 71 and the pull cam 72 are changed, the relative position ratio of the first upper point $U_1$, the first lower point $L_1$, the second upper point $U_2$ and the second lower point $L_2$ can be correspondingly adjusted, while the movement position of the piston 1 corresponding to various rotation angles of the camshaft 8 also can be adjusted. In other words, the ratio of the intake/exhaust strokes and/or the ratio of the compression/power strokes can be varied, while the upper volume of the chamber in the cylinder 2 corresponding to various rotation angles of the camshaft 8 also can be varied. In a case that the displacement of the power/exhaust strokes of the piston 1 in the cylinder 2 is increased to be relatively greater than the displacement of the intake/compression strokes thereof and the rotation angle of the camshaft 8 corresponding to the second lower point $L_2$ of the piston 1 is increased (i.e. the angle range of the camshaft 8 corresponding to the intake/compression strokes is widened), the combustion efficiency, the exhaustion efficiency and the power output can be simultaneously enhanced.

Figure 5A:
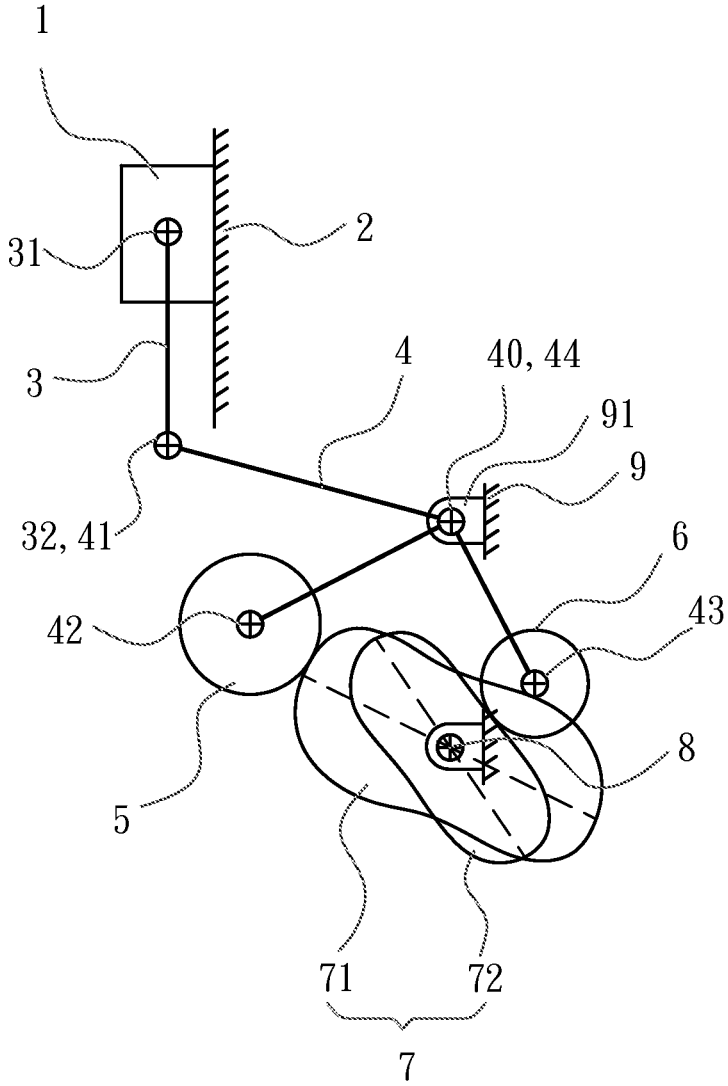
FIGS. 5A and 5B are a simplified schematic view of an engine structure having conjugate cam assembly and a diagram of the camshaft angle and the piston movement position thereof according to a second embodiment of the present invention.
Figure 5B:
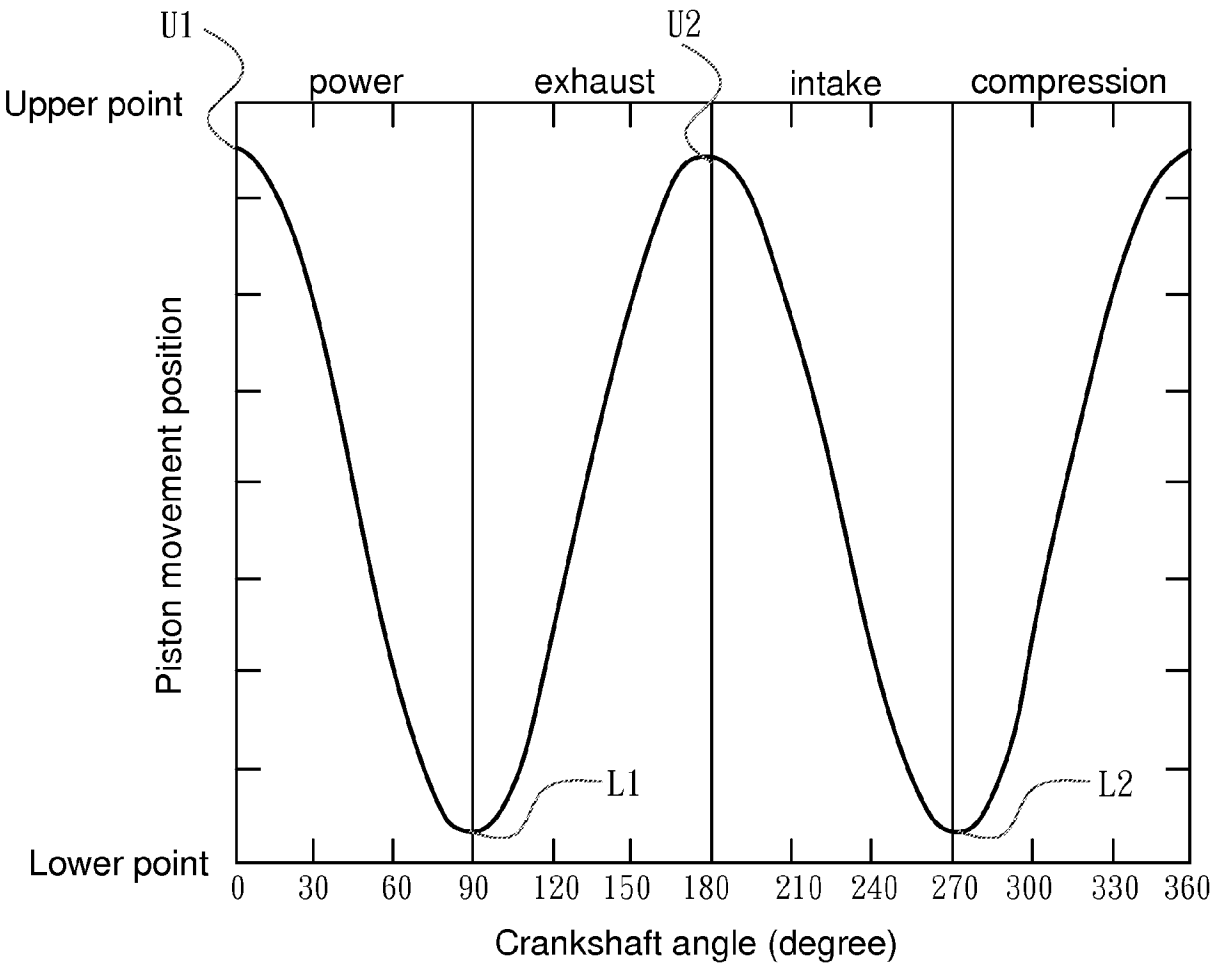

Referring to FIGS. 5A and 5B, an engine structure having conjugate cam assembly according to a second embodiment of the present invention is illustrated and similar to the first embodiment, so that the second embodiment uses similar numerals of the first embodiment. As shown, the difference between the first and second embodiments is described, as follows: As shown in FIG. 3, in the first embodiment, the cam profile of the pull cam 72 is substantially disposed within the range of the cam profile of the push cam 71, or is slightly projected out of the range of the cam profile of the push cam 71. As shown in FIG. 5A, in the second embodiment, a portion of the cam profile of the pull cam 72 (such as two ends or one end thereof) is apparently projected out of the range of the cam profile of the push cam 71. Meanwhile, the cam profiles of the push cam 71 and the pull cam 72 can be adjusted, and a third included angle defined between a length direction of the push cam 71 and a length direction of the pull cam 72 can selectively become greater or smaller than that of the first embodiment. Therefore, the relative position ratio of the first upper point $U_1$, the first lower point $L_1$, the second upper point $U_2$ and the second lower point $L_2$ can be correspondingly adjusted, while the ratio of the intake/exhaust strokes and/or the ratio of the compression/power strokes can be varied. For example, in a certain adjustment case, the position of the first lower point $L_1$ can be equal to that of the second lower point $L_2$ for suitably increasing the displacement for the intake stroke of the piston 1, so that the inner volume of the chamber in the cylinder 2 for receiving the combustible mixture gas can be suitably increased.

Figure 6:
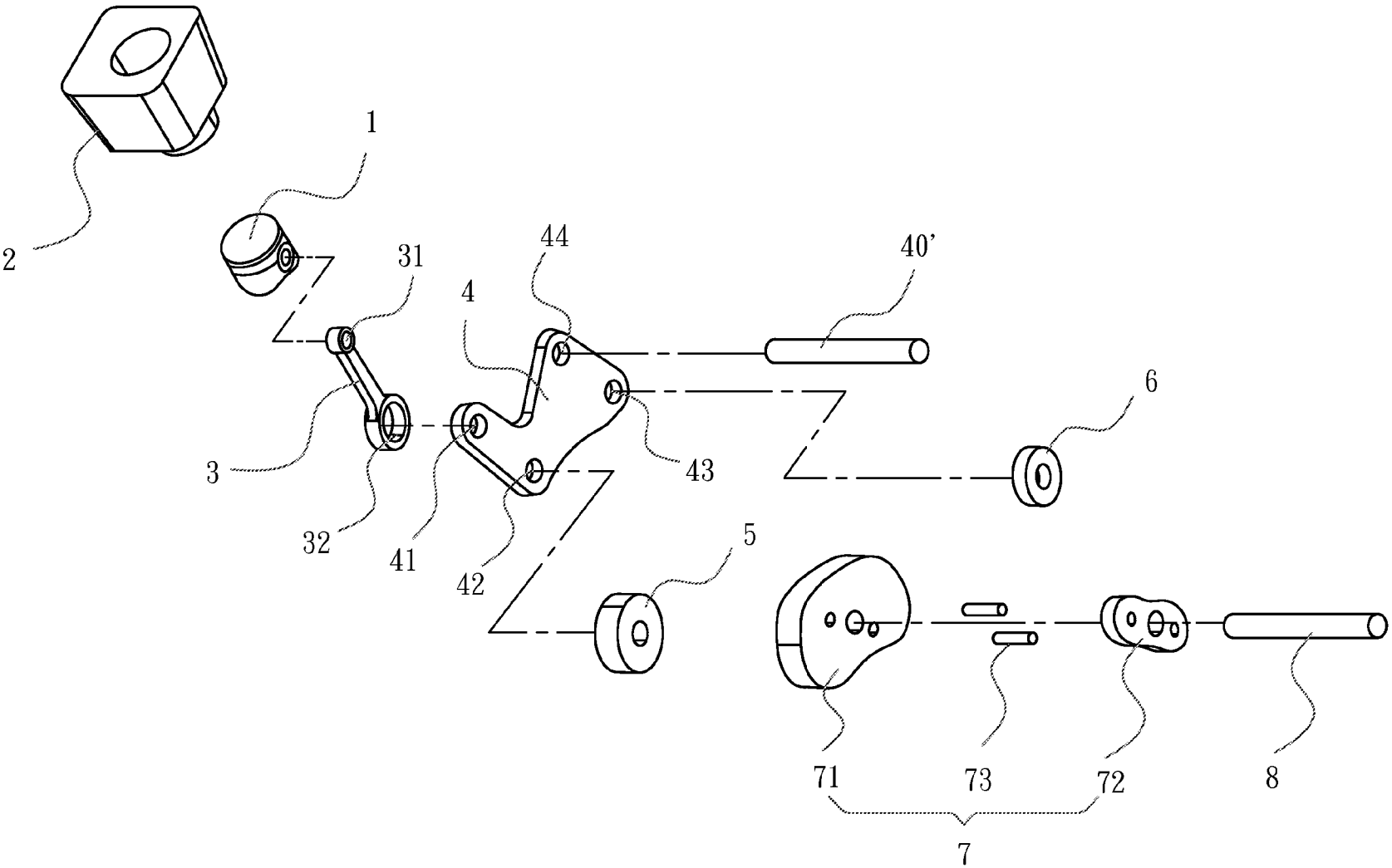
FIG. 6 is an exploded perspective view of an engine structure having conjugate cam assembly according to a third embodiment of the present invention.

Referring to FIG. 6, an engine structure having conjugate cam assembly according to a third embodiment of the present invention is illustrated and similar to the first embodiment, so that the third embodiment uses similar numerals of the first embodiment. As shown, the difference between the first and third embodiments is described, as follows: As shown in FIG. 3, in the first embodiment, the fulcrum point 44 of the roller rocker 4 is pivotally connected to the fixation base 91 on the inner wall of the crankcase 9 through the pivotal member 40 (such as a pin or bolt), wherein a single set of the engine structure can be independently operated. As shown in FIG. 6, in the third embodiment, the fulcrum point 44 of the roller rocker 4 is pivotally connected to a fixation rod 40', wherein two or more sets of the engine structures can be arranged side by side. In other words, the same fixation rod 40' and the same camshaft 8 are used to serial-connect the roller rockers 4 and the conjugate cam assembly 7 of two or more sets of engine structures. Thus, the total power output of the camshaft 8 can be increased.

As described above, in the traditional four-stroke type engine structure, each of the four strokes of the piston 103 has equal displacement, and the crankshaft 106 must rotate two circles to finish the four strokes, so that the ratio of the four strokes can not be adjusted and the problem of the remaining exhaust gas can not be solved. In comparison, according to the engine structure having conjugate cam assembly of the present invention as shown in FIGS. 2 to 6, the engine structure has the piston 1 used to push or pulled by the conjugate cam assembly 7 mounted on the camshaft 8 through the connection rod 3, the roller rocker 4 and the two rollers 5, 6, while the push cam 71 and the pull cam 72 of the conjugate cam assembly 7 have cam profiles and relative arrangement angle which can be varied according to actual operational desire, so as to vary the ratio of intake/exhaust strokes and the ratio of compression/power strokes. Thus, the combustion efficiency and the exhaustion efficiency can be enhanced, while the power output can be increased. Moreover, the camshaft 8 only rotates one circle (i.e. 360 degree) when the piston 1 finishes the four strokes of an operational cycle. Thus, the variation range of rotation speed of the camshaft 8 can be narrowed, the operational loading of the camshaft 8 can be reduced, the component abrasion of external mechanism can be decreased, and the entire volume of the engine can be minimized.

The present invention has been described with a preferred embodiment thereof and it is understood that many changes and modifications to the described embodiment can be carried out without departing from the scope and the spirit of the invention that is intended to be limited only by the appended claims.

The invention claimed is:

1. An engine structure having conjugate cam assembly, comprising:

a piston received in a cylinder for reciprocally linearly shifting in relation to an axial direction of the cylinder;

a connection rod having a first end and a second end, wherein the first end is pivotally connected to the piston, so that the connection rod is simultaneously moved with the piston;

a roller rocker having a power source end, a first roller connection point, a second roller connection point and a fulcrum point, wherein the second end of the connection rod is pivotally connected to the power source end for driving the first and second roller connection points to rotate in relation to the fulcrum point;

a push roller pivotally connected to the first roller connection point of the roller rocker;

a pull roller pivotally connected to the second roller connection point of the roller rocker; and a conjugate cam assembly mounted on a camshaft and having a push cam and a pull cam connected to the push cam; wherein the push cam has a non-circular cam profile different from that of the pull cam; and wherein the cam profile of the push cam is in contact with the push roller, while the cam profile of the pull cam is in contact with the pull roller;

wherein the engine structure is a four-stroke type engine structure, and one circle of rotation of the conjugate cam assembly and the camshaft is corresponding to all of a power stroke, an exhaust stroke, an intake stroke and a compression stroke of the piston of the engine structure; a first included angle is defined between a connection line of the power source end and the fulcrum point and a connection line of the first roller connection point and the fulcrum point, and the first included angle is smaller than 90 degree; the size of the push roller is greater than that of the pull roller, while the size of the push cam is greater than that of the pull cam; and the cam profile of the pull cam is substantially disposed within the range of the cam profile of the push cam.

2. The engine structure having conjugate cam assembly according to claim 1, wherein the ratio of the intake stroke and the exhaust stroke is equal to the ratio of a portion of the cam profile of the push cam or the pull cam corresponding to the intake stroke and the exhaust stroke.

3. The engine structure having conjugate cam assembly according to claim 1, wherein the ratio of the compression stroke and the power stroke is equal to the ratio of a portion of the cam profile of the push cam or the pull cam corresponding to the compression stroke and the power stroke.

4. The engine structure having conjugate cam assembly according to claim 1, wherein the power stroke, the exhaust stroke, the intake stroke and the compression stroke of the piston are corresponding to four displacements defined between a first upper point, a first lower point, a second upper point, a second lower point and the first upper point of the piston in the cylinder, respectively, wherein the first upper point is higher than or equal to the second upper point, and the first lower point is lower than or equal to the second lower point.

5. The engine structure having conjugate cam assembly according to claim 4, wherein the ratio of the intake stroke and the exhaust stroke is equal to the ratio of the displacement between the second upper point and the second lower point of the piston and the displacement between the first lower point and the second upper point of the piston.

6. The engine structure having conjugate cam assembly according to claim 4, wherein the ratio of the compression stroke and the power stroke is equal to the ratio of the displacement between the second lower point and the first upper point of the piston and the displacement between the first upper point and the first lower point of the piston.

7. The engine structure having conjugate cam assembly according to claim 1, wherein the fulcrum point of the roller rocker is pivotally connected to a fixation base on an inner wall of a crankcase through a pivotal member.

8. The engine structure having conjugate cam assembly according to claim 1, wherein the fulcrum point of the roller rocker is pivotally connected to a fixation rod.

9. The engine structure having conjugate cam assembly according to claim 1, wherein a second included angle is defined between a connection line of the power source end and the fulcrum point and a connection line of the second roller connection point and the fulcrum point, and the second included angle is greater than 90 degree.

10. The engine structure having conjugate cam assembly according to claim 1, wherein a third included angle is defined between a length direction of the push cam and a length direction of the pull cam, and the third included angle is smaller than 90 degree.

* * * * *